United States Patent [19]

McMaster

[11] 4,368,567

[45] Jan. 18, 1983

[54] GLASS CONVEYOR ROLL FINISHING TECHNIQUE

[76] Inventor: Harold A. McMaster, 707 Riverside Dr., Woodville, Ohio 43469

[21] Appl. No.: 210,457

[22] Filed: Nov. 25, 1980

[51] Int. Cl.[3] ..... B21B 27/02

[52] U.S. Cl. ..... 29/121.1

[58] Field of Search ..... 29/121.1, 121.4, 121.5; 51/144, 145 R, 145 T, 142, 289 R, 283 R, 267

[56] References Cited

U.S. PATENT DOCUMENTS 3,270,466 9/1966 George et al. ..... 51/142 X 3,881,887 5/1975 McMaster ..... 51/289 R X

OTHER PUBLICATIONS

Timerauers, Inc. Grino Brochure Model G-18-2 (8-1974).

*Primary Examiner*—Eugene F. Desmond

*Attorney, Agent, or Firm*—Reising, Ethington, Barnard, Perry & Brooks

[57] ABSTRACT

A technique for finishing a diamond ground outer surface (14) of a hot glass sheet conveyor roll (16) made of sinter bonded fused silica particles utilizes a continuous abrasive belt (26) to perform a finish grinding process on the outer surface. The process is performed by rotating the roll (16) about a central axis A thereof and driving the continuous abrasive belt (26) so as to finish grind the roll while moving the driven belt along the roll length. Silicon carbide is preferably utilized as the abrasive of the belt (26). The belt is preferably driven so as to engage the rotating roll surface (14) in an oppositely moving relationship and is moved in both directions along the length of the roll. During the finish grinding, the roll is flooded with water to provide a lubricant that dissipates heat and removes ground off particles. The ground outer surface (14) includes projections (55) having top surfaces (56), sloped sides (58), and curved junctions (60) connecting the top surfaces and the sloped sides.

1 Claim, 4 Drawing Figures

GLASS CONVEYOR ROLL FINISHING TECHNIQUE

TECHNICAL FIELD

This invention relates to a technique for finishing a diamond wheel ground outer surface of a hot glass sheet conveyor roll made of sinter bonded fused silica particles.

BACKGROUND ART

One type of system for bending and/or tempering glass sheets includes a horizontal roller conveyor on which glass sheets are conveyed during heating within a furnace of the system. Steel rolls which have previously been utilized with such conveyors have a relatively large coefficient of thermal expansion and thus tend to warp such that it is difficult to maintain roll straightness so that the heated glass sheet is conveyed in a single plane in its softened condition. Another type of conveyor roll for conveying hot glass sheets is made of sinter bonded fused silica particles which have a relatively small coefficient of thermal expansion and thus are capable of maintaining straightness upon heating such that glass sheets can be conveyed in a single plane.

U.S. Pat. No. 3,881,887 discloses apparatus and a method that has been used with diamond grinding wheels to grind the outer surfaces of conveyor rolls made of sinter bonded fused silica particles. Rough and finish diamond grinding wheels utilized are moved along the length of the roll during rotation of the roll about its central axis, and the diamond wheels are rotated about associated axes that are slightly skewed from a perpendicular relationship with the roll axis such that the loading is an axial direction so as not to bend the roll as can happen when radial forces are applied. The rough grinding wheel leads the finish grinding wheel by only a slight extent such that any radial forces applied by the wheels are opposed by each other in order to provide a diamond wheel ground outer surface of a round shape that is relatively straight along the complete length of the roll.

Fused silica conveyor rolls for hot glass sheets have previously been finished by a centerless grinding process using a lapping compound in order to produce a mirror-like surface. During such a grinding process, surface projections being ground have top surfaces and sloped sides as well as sharp junctions connecting the top surfaces and the sloped sides. Considerable time and consequent expense is required to completely grind off the projections to the final mirror-like surface.

DISCLOSURE OF INVENTION

Applicant has discovered that diamond wheel grinding of hot glass sheet conveyor rolls made of sinter bonded fused silica particles produces sharp peaks even when very fine grit diamond is utilized because the rigid support of the hard diamond tears out the roll material. Furthermore, Applicant has determined that these sharp peaks mark conveyed hot glass sheets in a manner that reduces the strength that can be achieved by tempering the glass since stresses are concentrated at the marks. In addition, Applicant has determined that these sharp peaks on the outer surface can result in a buildup of residue that expands and contracts upon heating and cooling and thereby distorts the roll shape and prevents conveyance in a single plane.

A roll finishing technique according to this invention for hot glass sheet conveyor rolls made of sinter bonded fused silica particles utilizes a finish grinding process that removes sharp peaks on the outer roll surface after the initial diamond wheel grinding thereof so as to thereby avoid the problems that result from such sharp peaks.

The finish grinding process is performed with a continuous abrasive belt having an abrasive softer than the diamond grinding wheel that initially grinds the surface. Use of the softer abrasive and the less rigid support thereof on a continuous belt, as compared to the more rigid support of abrasive by the matrix of a grinding wheel, removes the sharp peaks without tearing out material of the roll and thereby generating additional sharp peaks.

The process is performed by rotating the roll about a central axis thereof and driving the continuous abrasive belt so as to finish grind the roll while moving the driven belt along the length of the roll.

In the preferred practice, the finish grinding is performed with a continuous silicon carbide belt. Best results are achieved by driving the abrasive belt such that a reach thereof engages the outer surface of the rotating roll while moving in an opposite direction thereto in order to provide high speed grinding. The driven belt is also preferably moved along the length of the roll in both directions to remove the sharp peaks from the outer surface. Furthermore, the roll is flooded with water during the finish grinding in order to provide a lubricant that dissipates heat generated and removes ground off particles.

A hot glass sheet conveyor roll finished in accordance with the invention has an elongated shape made of sinter bonded fused silica particles and has an outer surface including projections having ground top surfaces and sloped sides as well as curved junctions connecting the top surfaces and the sloped sides. The ground top surfaces are straight along the length of the roll and cooperatively define a round cross-section therealong such that conveyed glass sheets are supported by a generally straight line contact. The projections do not mark conveyed hot glass sheets because the curved junctions of the top surfaces and the sloped sides eliminate any abrupt discontinuities along the surface.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
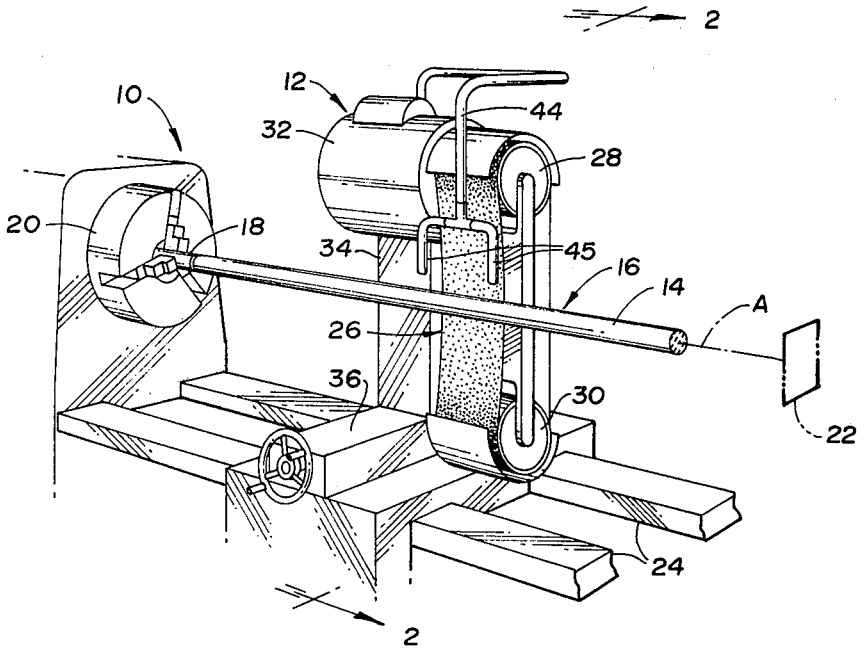
FIG. 1 is a perspective view illustrating the glass conveyor roll finishing technique of the invention.

Referring to FIG. 1 of the drawings, a finishing technique of the invention is performed on a lathe 10 by an abrasive belt sander 12 that finish grinds the outer surface 14 of a hot glass sheet conveyor roll 16 made of sinter bonded fused silica particles. As is hereinafter more fully described, the outer roll surface 14 is diamond ground prior to the finish grinding which is performed with an abrasive softer than diamond so as to remove sharp peaks from the outer surface.

Conveyor roll 16 illustrated in FIG. 1 has an elongated shape with one end that is supported by a spindle 18 on a rotatable headstock 20 of the lathe and another end that is supported by a schematically indicated tailstock 22 such that the roll is rotatively driven about a central axis A thereof during the finish grinding. Tailstock 22 is mounted on ways 24 of the lathe in a conventional manner for movement toward and away from the headstock 20 so as to accommodate conveyor rolls 16 of different lengths.

Figure 2:
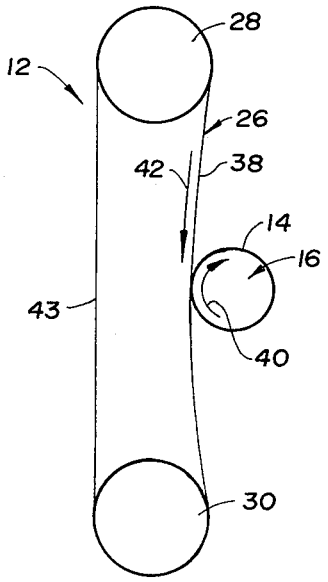
FIG. 2 is a schematic view taken along the direction of line 2—2 of FIG. 1 and illustrating a finish grinding process of the invention.

With combined reference to FIGS. 1 and 2, the sander 12 includes an abrasive belt 26 preferably having a silicon carbide abrasive and is received by an upper drive roller 28 and a lower idler roller 30. An electric motor 32 that drives the upper roller 28 is mounted by a support 34 on a carriage 36 that is movable along the ways 24 of the lathe. One reach 38 of the silicon carbide belt 26 engages the outer roll surface 14 as the conveyor roll 16 is rotated by the lathe and moves in an opposite direction thereto as illustrated by arrows 40 and 42 to provide the finish grinding process. The other belt reach 43 is driven upwardly from the idler roller 30 to the drive roller 28 in an opposite direction to the grinding reach 38. Carriage 36 is preferably moved from adjacent one end of the roll 16 to adjacent the other end thereof and then back toward the first end by a power feed such that the roll is finish ground along its complete length.

The silicon carbide of the continuous belt 26 preferably has a grain size or grit of 320, i.e. the particles will pass through a standard wire screen having 320 openings per inch but will not pass through a standard wire screen having 400 openings per inch. Also, the silicon carbide belt is preferably of the "wet" type having a water resistant adhesive that binds the abrasive silicon carbide particles to a continuous backing since the conveyor roll 16 is preferably flooded with water during the finish grinding process for best results. As seen in FIG. 1, a water supply conduit 44 mounted with the electric motor 32 on the movable carriage support 34 has a pair of downwardly extending outlets 45 through which the water is supplied.

Best results are achieved by relatively high speed grinding which is facilitated by the oppositely moving relationship of the grinding belt reach 38 and the outer roll surface 14 as illustrated in FIG. 2. An interface speed between the surface 14 and the belt reach 38 of about 1000 feet/minute is sufficient while a somewhat higher interface speed on the order of about 3000 feet/minute can be used to increase the belt life.

Figure 3:
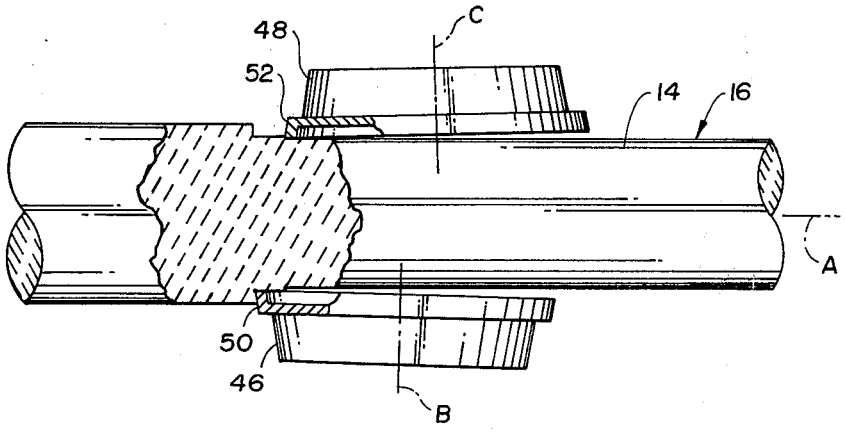
FIG. 3 is a view illustrating a diamond grinding step that is performed prior to finish grinding.

With reference to FIG. 3, the conveyor roll 16 is initially diamond ground prior to the finish grinding by rough and finish diamond grinding wheels 46 and 48. Conveyor roll 16 is mounted along its central axis A for rotation on a lathe whose power driven carriage supports the grinding wheels 46 and 48 at leading and trailing positions about associated rotational axes B and C which are slightly skewed from a perpendicular relationship to the axis A of the roll. Driving of the grinding wheels 46 and 48 about their associated rotational axes B and C during axial movement along the roll axis A engages their annular peripheries 50 and 52 on which abrasive diamonds are secured with the conveyor roll to provide the diamond ground surface 14.

Figure 4:
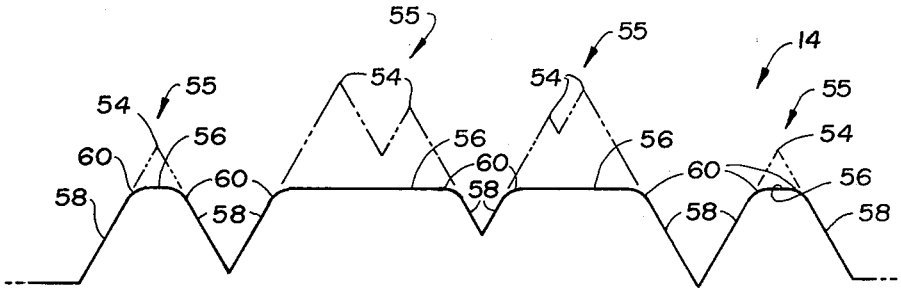
FIG. 4 is a greatly enlarged view illustrating the manner in which sharp peaks on the outer roll surface are removed by the finish grinding process.

As seen in FIG. 4, the outer surface 14 of the conveyor roll has sharp peaks 54 after the diamond grinding process described above in connection with FIG. 3. Finish grinding of the roll surface 14 by the process of this invention removes the sharp peaks 54 and provides projections 55 having ground top surfaces 56 that are straight along the length of the roll 16 and which cooperatively define the round cross-section of the roll about axis A. The ground projections 55 have sloped sides 58 as well as curved junctions 60 connecting the ground top surfaces 56 and the sloped sides. Hot glass sheets conveyed on roll surface 14 are supported in a straight line contact by the ground top surfaces 56 of the projections. Even though the sloped sides 58 define valleys between the projections, hot glass sheets are not marked by the projections because the ground top surfaces 56 are connected by the curved junctions 60 with the sloped sides. After tempering, the glass strength is not decreased by stress concentrations about any marks on the glass surface. Additionally, removing the sharp peaks 54 decreases the tendency of the outer roll surface 14 to collect residue during conveyance of heated glass sheets.

While the best mode for practicing the invention has been described in detail, those familiar with the art to which this invention relates will recognize various alternative ways of practicing the invention as defined by the following claims.

What is claimed is:

1. A hot glass sheet conveyor roll of an elongated shape with a round cross-section and made of sinter bonded fused silica particles, the roll comprising: an outer surface including projections having ground top surfaces that are straight along the length of the roll and which cooperatively define the round cross-section of the roll; said projections having sloped sides; and curved junctions connecting the top surfaces and the sloped sides of the projections whereby the projections do not mark conveyed hot glass sheets in their softened condition.

* * * * *